US005375825A

United States Patent [19]

Kennish

[11] Patent Number: 5,375,825

[45] Date of Patent: Dec. 27, 1994

[54] ACCUMULATOR WITH "FIRST PAGE HOLD" FEATURE

[75] Inventor: James R. Kennish, Chester, Conn.

[73] Assignee: GBR Systems Corporation, Chester, Conn.

[21] Appl. No.: 137,558

[22] Filed: Oct. 18, 1993

Related U.S. Application Data

[63] Continuation of Ser. No. 35,086, Mar. 22, 1993.

[51] Int. Cl.[5] ..... B65H 43/06

[52] U.S. Cl. ..... 270/58; 271/110; 271/265

[58] Field of Search ..... 270/46, 58, 59; 271/110, 111, 258, 265, 215, 216, 272, 275

[56] References Cited

U.S. PATENT DOCUMENTS

| | | | |
|---|---|---|---|
| 3,744,649 | 7/1973 | Ward, Jr. | 414/788.7 |
| 3,871,539 | 3/1975 | Nikkel | 271/212 X |
| 4,302,198 | 11/1981 | Kawada | 270/58 X |
| 4,541,764 | 9/1985 | Govan et al. | 414/52 |
| 4,569,513 | 2/1986 | Backman | 271/258 X |
| 4,799,663 | 1/1989 | Golicz | 271/199 |
| 4,805,891 | 2/1989 | Luperti et al. | 271/212 |
| 4,925,362 | 5/1990 | Golicz | 271/157 X |
| 4,955,964 | 9/1990 | Hain | 271/225 |
| 5,083,769 | 1/1992 | Young, Jr. | 271/280 |
| 5,147,092 | 9/1992 | Driscoll et al. | 271/184 |
| 5,178,379 | 1/1993 | Edwards et al. | 271/189 |
| 5,244,200 | 9/1993 | Manzke | 271/198 |
| 5,265,731 | 11/1993 | Van de Ven | 271/212 X |
| 5,289,251 | 2/1994 | Mandel et al. | 270/59 X |

*Primary Examiner*—Edward K. Look
*Assistant Examiner*—John Ryznic
*Attorney, Agent, or Firm*—Stoll, Miskin, Previto & Hoffman

[57] ABSTRACT

An accumulator with first page hold feature having an accumulating area and a mechanism for feeding sheets of a first group of sheets to the accumulating area. An identifying mechanism is provided to identify the first sheet of a second group of sheets. The first sheet of said second group is fed but is stopped before the first sheet reaches the accumulating area. In the meantime, first group of sheets is released from the accumulating area and the first sheet of the second group is then released from its stopped position and fed to the accumulating area.

13 Claims, 1 Drawing Sheet

ACCUMULATOR WITH "FIRST PAGE HOLD" FEATURE

RELATED APPLICATION

This is a continuation of U.S. patent application Ser. No. 08/35,086 filed Mar. 22, 1993.

BACKGROUND

The present invention relates to a feeding mechanism and more particularly to an improved feeding mechanism adopted to sequentially feed single sheets of paper or the like one at a time onto a stacking or accumulation area and to periodically release a stack from the accumulation area when the stack reaches a certain thickness.

This application is an improvement over U.S. Pat. No. 4,799,663 (owned by the same entity which owns this application), U.S. patent application Ser. No. 08/112,193 filed Aug. 26, 1993 (also owned by the same entity which owns this application) U.S. Pat. Nos. 4,640,506 and 5,083,769.

As described and shown in said U.S. Pat. No. 4,799,663, single sheets of paper are moved individually over an inclined ramp and are stacked in a stacking or accumulation area in front of the inclined ramp. The accumulation area is comprised of the front wall of the ramp and a plurality of stop wheels which have notches therein which are spaced forwardly of the ramp and against which the sheets of paper abut. When a predetermined number of sheets are deposited in the accumulation area, the stop wheels are rotated thereby releasing the entire stack for forward movement. When the accumulation area is clear, a new stack of sheets is deposited in the accumulation area and the process is repeated. The structure described in this patent accumulates sheets from the bottom up with the first sheet deposited on the bottom of the accumulating area and subsequent sheets deposited on top of one another until the desired stack thickness is reached.

The mechanism shown and described in said Ser. No. 08/112,193 comprises a sheet feeding mechanism having an accumulator station and a pre-accumulator station in advance of the accumulator station. Sheets of a first group of sheets are fed to the accumulator station. Sheets of a second group of sheets are fed to the pre-accumulator station. The sheets of the second group are stacked in the pre-accumulator station. The first group of sheets from the accumulator station are released and the sheets of the second group are released from the pre-accumulator and fed to the accumulator station after the accumulator station is clear of sheets.

The mechanism described in U.S. Pat. No. 4,640,506 is directed to an attachment to the structure shown in U.S. Pat. No. 4,799,633. With this attachment, the sheets are accumulated in the accumulation area from the top down with the first sheet deposited at the top of the accumulation area and subsequent sheets deposited below the top sheet until the desired stack thickness is reached.

In both of the devices described in said U.S. Pat. Nos. 4,640,506 and 4,799,633 once a stack thickness has been reached, the stack is moved out of the way and a new stack accumulation starts. However, the new stack accumulation cannot begin until after the old stack is removed from the accumulation area. In today's high speed processing sheets, this delay is unsatisfactory since the stacking the sheets cannot meet the number of sheets being fed from some other source, such as a printer.

U.S. Pat. No. 5,083,769 is directed to a dual accumulator in vertical relationship with each other and in which a pivoted ramp is provided which moves from an upper position to a lower position and alternately directs sheets of paper first to the upper accumulator and thereafter to the lower accumulator. It will be appreciated that the use of two accumulators in the manner set forth in this patent creates duplication of effort and increases expenses.

Typically, in the preparation of documents a series of sheets are fed and stacked at a stacking station. The necessary number of sheets have been stacked to form a complete document (such as an insurance policy). The completed stack is moved to some other processing mechanism. With high speed feeding mechanisms, it is possible that when the end of a stack of sheets comprising the first document is being assembled, the first sheets of a second document are also being fed. In this situation, the feeding must stop until the first document is cleared from its stacking station and the sheets of the second document are fed to the stacking station. In addition, with such high speed input feeders it is sometimes possible for a third group of sheets forming a third document to also be fed before the first document is removed from the stacking station. Again, with existing mechanisms the feeding of all these sheets must stop until the stacking area is cleared of documents.

CURRENT STATE-OF-THE-ART

Based on programming requirements a typical in the mail inserting industry, it is customary to identify individual document groups with optical marks or bar codes, which identify all pages belonging to a particular group. When processing groups in sequence, such optical mark coding may not permit the timely recognition of an end of group, especially when the end of group is supposed to be triggered solely by the appearance of a new group ID, as printed on the next following document.

The industry has dealt with this condition by providing a special module, positioned prior to the actual accumulator, and which would permit the capture of the next following first page in what is referred to as a "first page hold" position until such time that the prior group has vacated the accumulating station.

This practice of extra first page hold positions adds a minimum of a fold document depth, plus additional transport mechanisms to the length of the entire system, let alone increases the cost and complexity of the processing system.

OBJECTS

The present invention avoids these drawbacks and has for one of its objects the provision of an improved accumulator in which the first sheets are held in a pre-accumulation area until the previously deposited stack of sheets to be moved off the accumulating area.

Another object of the present invention is the provision of an improved accumulator in which the sheet to be held is marked.

Another object of the present invention is the provision of an improved accumulator in which the accumulation of sheets in a stack is accomplished without delays incurred in previously existing mechanisms.

Other and further objects of the invention will be obvious upon an understanding of the illustrative embodiment about to be described, or will be indicated in the appended claims and various advantages not referred to herein will occur to one skilled in the art upon employment of the invention in practice.

NEW STATE-OF-THE-ART

The invention further on described will not only reduce the required space, but will also permit the retrofitability of such first page hold feature to accumulation systems which have previously not been fitted with such an extra module as described before.

This is accomplished by an accumulator with a first page hold feature which is the subject of the present invention. The accumulator has an accumulating area and a mechanism for feeding sheets of a first group of sheets to the accumulating area. An identifying mechanism is also provided to identify the first sheet of a second group of sheets. The first sheet of said second group is fed but is stopped and held in a holding area before the first sheet reaches the accumulating area. In the meantime, the first group of sheets which have accumulated in a stack is released from the accumulating area and the first sheet of the second group is then released from its stopped position in the holding area and fed to the accumulating area. The additional sheets of the second group of sheets are then fed to the accumulating area without stopping at the holding area. The invention provides for data to be provided on the sheets to identify the last page of a first group, or the first page of a second group, or both.

BRIEF DESCRIPTION OF THE DRAWING

A preferred embodiment of the invention has been chosen for purposes of illustration and description and is shown in the accompanying drawings forming a part of the specification, wherein.

DESCRIPTION

Figure 1:
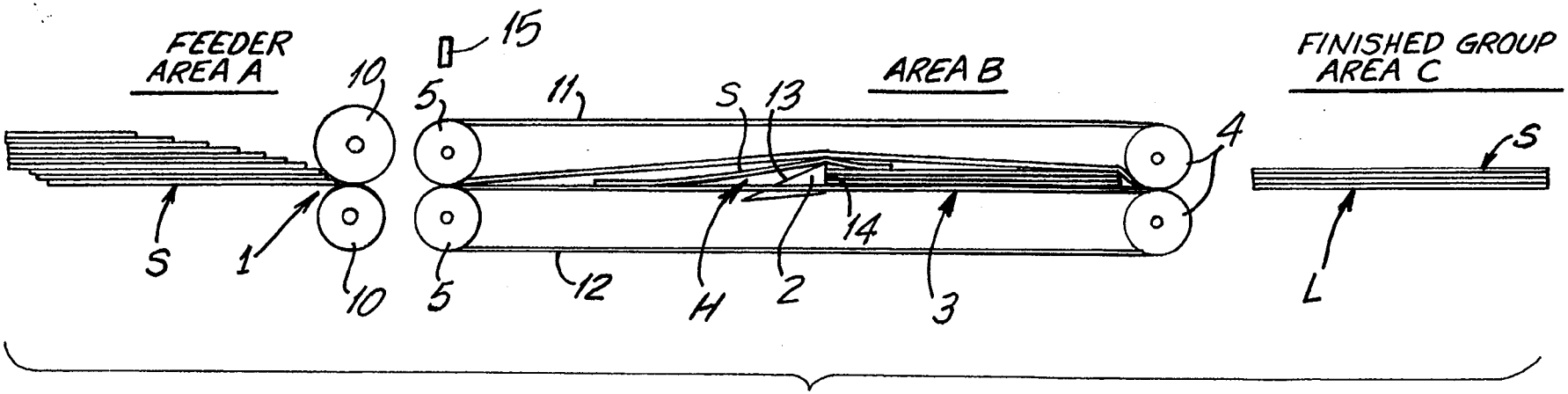
FIG. 1 is a diagrammatic view showing the structure used in connection with the present invention.

Referring to the drawings and more particularly to FIG. 1, a plurality of sheets S are fed from a Feeder Area A by a feeder 1. Feeder 1 comprises a pair of feed rollers 10 between which each sheet S is fed. If the sheet S is the first page or part of a first group of sheets to form a first document L, the sheets S will be moved to an Accumulator Area B which as an accumulation area 3 on which the fed sheets S are stacked. When the stack complete, the sheets S are further moved to a Finished Group Area C.

The Accumulating Area B comprises a pair of upper and lower transparent belts 11–12 driven by a pair of clutched rollers 5. The clutched rollers 5 are adapted to move each sheet S into the accumulating area 3. The accumulating area 3 comprises a ramp 2 forming the rear of the accumulating area and a pair of clutched rollers 4 forming the frame of the accumulating area 3. The ramp 2 has a sloping upper wall 13 and a substantially straight front wall 14. Sheets S are fed by belts 11–12 over the ramp 2 and are deposited and accumulate in the accumulating area 3 between front wall 14 of ramp 2 and clutched rollers 5. When a sufficient number of sheets S have accumulated in the accumulating area 3, the stack is moved by clutched rollers 4 to the Finished Group Area C to be further processed.

Starting with a feeder 1, individual documents are sent to the accumulator area comprised of an accumulator ramp 2 and a document accumulation area 3, as well as the clutched stop rollers 4. In addition, the accumulator features belts driven by a clutched roller pair 5, designed transport the individual sheets into the accumulator area 3.

Under normal operations, i.e., without first page hold requirements, the feeder issues under optical mark control all documents belonging to one group into the accumulator area 3. Upon the recognition of a completion of the set (this information being contained on the last sheet of the document of the set fed), the clutched rollers 4 eject the finished group into the next following work station. The belted transports and rollers 5 are running continuously in such applications.

In a scenario where the first page hold requirement has to be dealt with, the before described accumulator arrangement operates as follows:

The normally continuously running rollers 5 and corresponding belts are being clutched and may be operated as and when required. Since this roller pair 5 is also operating the corresponding transport belts, roller pair 5 will, therefore, be in the control of the forward movement of any documents entering the accumulator.

When processing a first page hold OMR scenario, the first group will be issued to the accumulator area 3 until a page appears which identifies itself as the first page of a new group. In this case, the clutched roller pair 5 is energized and stops the document on top or in the area of ramp 2. The first group is now being ejected through the clutched rollers 4. The clutched roller 5 starts operation again issuing the first page into the accumulator with all subsequent pages following until again a first page of a new group is recognized and stopped as previously described.

As shown in FIG. 1, the sheets S are fed by feed rollers 10 to the feed rollers 5 of the accumulator area B. Each sheet S moves over the inclined surface of the ramp 2 and rests in the accumulation area 3 between the front wall 14 of the ramp assembly 2 and the clutch rollers 4. Each sheet is fed to this accumulation area 3 and is stacked on top of the previously deposited sheet. In this manner, a stack of sheets accumulates in the accumulation area 3. When a sufficient number of sheets are accumulated to form a complete document L, the clutch rollers 4 are activated and a stack of sheets moves out of the accumulation area 3 and into the finished group area C where the stack is further processed.

A sensor device 15 is provided to sense data on the sheets S and particularly data on the first sheet to each group. The data on the sheet may comprise any indicia which is sensed by the sensor 15. When the first page of a second group is sensed by the sensor 15 the first page thereof, (marked "sheet" in the drawing) is held in a holding area H in advance of the accumulation area 3. At this point, the clutch rollers 5 are stopped so that no more sheets are fed. In the drawing, the holding area H is shown overlying the ramp assembly 2. The stack in the accumulation area 3 is now complete and is in the process being moved out the accumulation area 3 by the clutch rollers 4 which are rotated to accomplish this. When the accumulation area 3 is thus emptied, the belts 12 are activated by rotating clutch rollers 5 and the first page is moved to the accumulation area 3. Additional sheets of the second group are thereafter moved into the accumulation area 3 by the rollers 5 and belts 12.

Preferably the sensor 15 is adapted to sense data on the first page of a second group of sheets. However, it is within the purview of the present invention that the sensing means 15 sense the data on the last page of the first group and then keep the first page of the second group in the holding area H.

A unique feature of this new concept is the ability to install a clutch onto an existing roller assembly 5, thus converting a field installed system into a first page hold concept system.

It is further envisioned that the drive in the ramp area 2 will be enhanced through the positioning of transport rollers which, in turn, are driven from belts originating from the left roller 5. Such additional transport rollers could function for the increase of drive force in order to both stop the first page document in the desired position, and at the same time to accelerate such document as and when required.

It will be seen that the present invention provides an improved accumulator in which the first sheets are held in a holding area until the previously deposited stack of sheets are moved off the accumulating area in which the sheet to be held in the holding area is marked with identifying data and in which the accumulation of sheets in a stack is accomplished without the delays incurred in previously existing mechanisms.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. An accumulator comprising an accumulating area, said accumulating area defined by a rear stop means and front stop means, means for feeding sheets of a first group of sheets to said accumulating area, said feeding means and said accumulating area being on substantially the same plane, each sheet fed by the feeding means adapted to move over said rear stop means and adapted to be deposited over any previously deposited sheet in said accumulating area, means for identifying the first sheet of a second group of sheets, means for feeding said first sheet of said second group toward said accumulating area, means for stopping the feeding of said first sheet of the second group before said first sheet reaches said accumulating area, means for releasing the first group of sheets from said accumulating area, means for releasing the said first sheet of said second group from said stopped position and feeding it to said accumulating area, said stopped position being an area overlying said rear stop means, said rear stop means is a ramp assembly provided in advance of said accumulating area and wherein the sheets being fed by the feeding means move over the said ramp assembly before they reach the accumulating area.

2. An accumulator as set forth in claim 1 wherein the said first sheet of a second group is held in a holding area in advance of said accumulating area.

3. An accumulator as set forth in claim 2 wherein means are provided to stop the feeding means from feeding sheets while said first sheet is in said holding area.

4. An accumulator as set forth in claim 3 wherein means are provided for moving the accumulated sheets out of the accumulating area to empty said accumulating area.

5. An accumulator as set forth in claim 4 wherein means are provided to commence feeding of the sheets of the second group when the accumulating area is empty of the first group.

6. An accumulator as set forth in claim 5 wherein said sensing means sense data on said first sheet of said second group.

7. An accumulator as set forth in claim 6 wherein said ramp is provided having an inclined upper surface and a substantially horizontal front surface and wherein said accumulating area is in front of said horizontal front surface.

8. An accumulator as set forth in claim 7 wherein the accumulating area has rollers and means are provided to activate the rollers when a stack in the accumulating area is complete, whereby the rollers move the stack out of the accumulating area.

9. An accumulator as set forth in claim 8 wherein rollers are provided to feed sheets into the accumulating area and wherein means are provided to stop said rollers form feeding sheets when the first page of a second group is identified by the identifying means.

10. The method of accumulating sheets comprising feeding sheets of a first group of sheets to an accumulating area defined by rear and front stop means, the sheets being fed on a plane which is substantiality the same as the plane of the accumulating area, the sheet being fed moving over the rear stop means and being deposited over any previously deposited sheets in the accumulating area, identifying the first sheet of a second group of sheets, feeding the said first sheet of said second group toward the accumulating area, stopping the feeding of said first sheet of the second group before said first sheet reaches the accumulating area and at an area overlying the rear stop means, releasing the first group of sheets from the accumulating area, and releasing the said first sheet of said second group from its stopped position and feeding it to said accumulating area.

11. A method as set forth in claim 3 wherein the accumulated sheets are moved out of the accumulating area to empty the accumulating area.

12. A method as set forth in claim 11 wherein feeding of the sheets of the second group is commenced when the accumulating area is empty of the first group.

13. A method as set forth in claim 12 wherein data on said first sheet of said second group is sensed.

* * * * *